US005154537A

United States Patent [19]

DeVries et al.

[11] Patent Number: 5,154,537

[45] Date of Patent: Oct. 13, 1992

[54] BARRIER CURTAIN

[75] Inventors: Jack DeVries, Dodoma, United Rep. of Tanzania; Carl Rhoads, Ventura, Calif.

[73] Assignee: The United States of America as represented by the Secretary of the Navy, Washington, D.C.

[21] Appl. No.: 706,505

[22] Filed: May 28, 1991

[51] Int. Cl.[5] ..... E02B 8/02

[52] U.S. Cl. ..... 405/60; 405/52; 405/63; 405/74

[58] Field of Search ..... 405/60, 63–72, 405/205, 73, 74

[56] References Cited

U.S. PATENT DOCUMENTS

| | | | |
|---|---|---|---|
| 3,589,133 | 6/1971 | Lowd | 405/205 X |
| 3,599,434 | 8/1971 | Missud | 405/68 X |
| 3,708,983 | 1/1973 | Brown et al. | 405/64 |
| 3,710,577 | 1/1973 | Matheson | 405/70 X |
| 3,744,254 | 7/1973 | Fennelly | 405/62 |
| 3,783,622 | 1/1974 | Gambel | 405/71 X |
| 3,818,708 | 6/1974 | Benson | 405/65 |
| 3,839,870 | 10/1974 | Ryan | 405/64 |
| 3,859,796 | 1/1975 | Benson | 405/70 X |
| 3,922,861 | 12/1975 | Grihange | 405/64 |
| 4,201,495 | 5/1980 | Preus | 405/63 |
| 4,252,461 | 2/1981 | Colamussi et al. | 405/115 |
| 4,280,438 | 7/1981 | Jackson | 405/64 |
| 4,373,834 | 2/1983 | Grace | 405/60 |
| 4,484,836 | 11/1984 | Bailard | 405/74 X |

*Primary Examiner*—Dennis L. Taylor

*Attorney, Agent, or Firm*—Ron Billi; Melvin J. Sliwka

[57] ABSTRACT

An apparatus for reducing sedimentation in ship berths including one or more modules, spanning the entrance of a ship berth and providing a continuous, homogeneous, impervious barrier, each module including a base located on the sea floor, an accordion type curtain extendable in the vertical direction and attached on its bottom side to the base, a float attached to the curtain on the top side, a primary operating system for raising and lowering the curtain and a secondary operating system for raising the entire apparatus to the sea surface for repair or removal.

23 Claims, 4 Drawing Sheets

Fig. 3a.
Fig. 4.
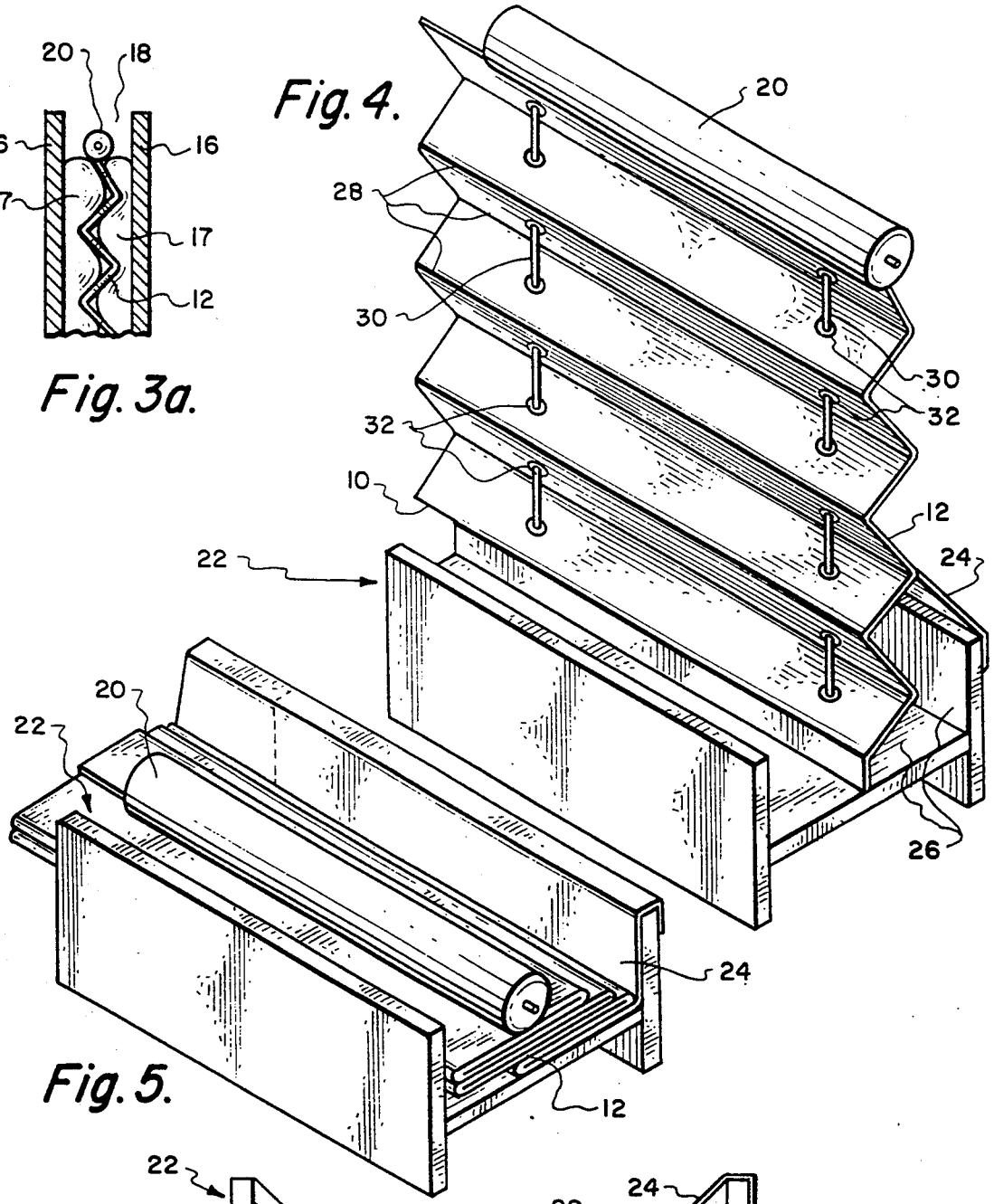
Fig. 5.
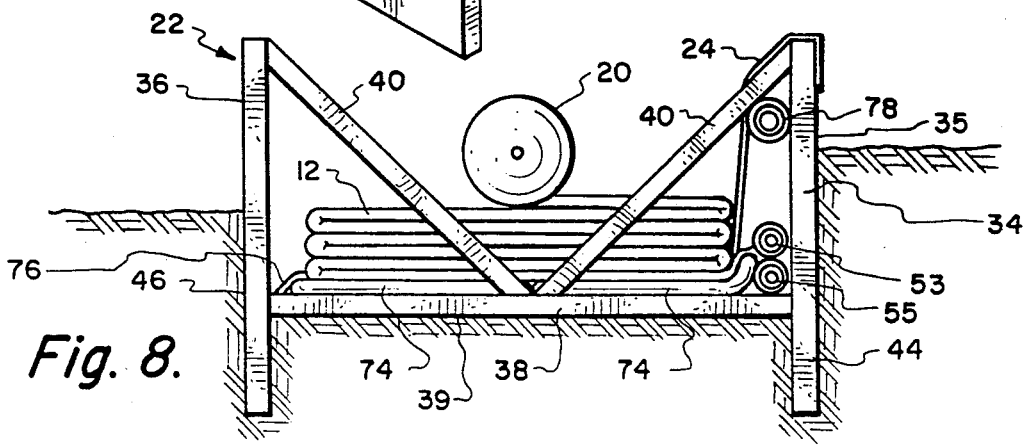
Fig. 8.

BARRIER CURTAIN

BACKGROUND OF THE INVENTION

This invention relates to an apparatus for reducing siltation in cul-de-sac type ship berths.

In the past, there have been attempts to develop a suitable device for reducing the flow of sediment (silt) into ship berths, however all have been unsuccessful. In 1980, Scripps Institute of Oceanography constructed and installed a device but it was soon removed because it required difficult and lengthy procedures to open and close. In 1981, Scripps deployed a second device but it too was unsuccessful and was removed four months after installation.

Two other attempts were made in the Netherlands, one in 1982 and one in 1987. Both of these devices had no moving parts and were supposed to allow ships to drive right over the top—both were unsuccessful and were soon damaged by contact with ship bottoms.

Other devices, such as dams and oil containing devices have been developed to both float and remain below the sea surface. All utilize some sort of barrier or containment means with floatation elements that may be inflated/deflated to raise/lower the device into position.

Representative patents showing various devices include U.S. Pat. No. 4,252,461; U.S. Pat. No. 3,922,861; U.S. Pat. No. 3,859,796; U.S. Pat. No. 3,839,870; U.S. Pat. No. 3,783,622; U.S. Pat. No. 3,710,577; U.S. Pat. No. 3,708,983; and U.S. Pat. No. 4,280,438.

However, none of these devices provide an apparatus that may be quickly and easily, raised, or lowered; that may be easily removed; that will prevent sedimentation in a ship berth; that ma be vertically positioned anywhere below the sea surface; that may be lowered by direct means; and that will fold in a repeatable manner when lowered.

Thus, there is a need in the art for providing an apparatus for reducing siltation in cul-de-sac type ship berths yet is easily and quickly lowered and raised to allow deep draft ships to enter/exit the berth, is easily removed for repair, maintenance or dredging and permits shallow draft boats to enter/exit the berth without lowering.

It is therefore an object of the present invention to reduce sedimentation in ship berths especially cul-de-sac type berths. It is another object of the present invention to provide a device that is easily and quickly raised or lowered. It is a further object of the present invention to provide a device that may be quickly and easily removed for repair or maintenance or when dredging of the berth is required. It is yet another object of the present invention to provide an apparatus that, when installed and operating in the fully extended or "up" position, will allow ships with shallow drafts, for example, harbor, maintenance or personnel craft to enter or leave a berth without impairment by the present invention. It is another object of the present invention to provide an apparatus that may be lowered by direct means. It is a further object of the present invention to provide an apparatus that when lowered will fold in a repeatable and predictable manner. It is yet another object of the present invention to provide an apparatus that may be vertically positioned anywhere above the ocean (sea) bottom.

SUMMARY OF THE INVENTION

Accordingly, the preferred embodiment of the present invention includes a plurality of modules, attached in an end to end fashion, to form a homogeneous unit of any desired length that can span the entrance of, for example, a cul-de-sac type ship berth. Each end of the so called barrier curtain slidably engages a channeled gasket, that is attached to one side of the berth entrance. Each module includes a base located on the sea floor; an accordion type, impervious screen attached to the base on its bottom edge, and capable of being raised or lowered in an up or down fashion; a float attached to the top of the screen providing upward (buoyancy) force for raising the screen; a primary operating system including winches and cables that operate to pull the screen and float downward to allow ships to enter or exit a berth; a secondary operating system including air bags mounted on the base and compressors located on shore for inflating the air bags to float the barrier curtain to the sea surface.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 3*a* is a cross section taken through line 3*a*—3*a* of FIG. 3.

FIG. 4 is a perspective view of a single module showing a base, an extended screen, a screen shield, a float, and the cables from the primary operating system.

FIG. 5 is a perspective view of a base showing a screen and float in the fully retracted position with the screen and shield folded.

FIG. 8 is a cross-sectional view showing a base located in a trench to enhance ship draft clearance.

DETAILED DESCRIPTION OF THE PREFERRED EMBODIMENT

Figure 1:
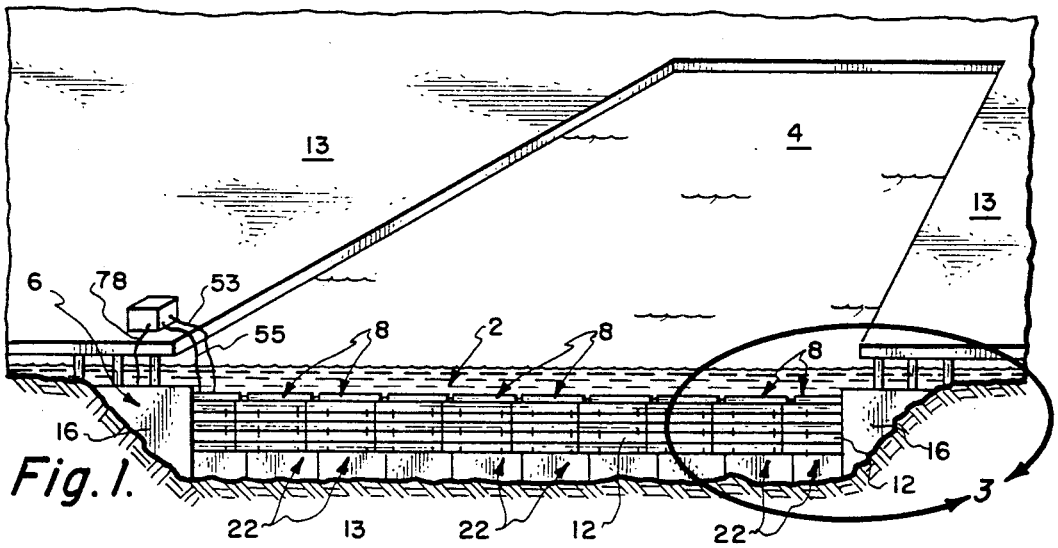
FIG. 1, partially in cross-section, shows the present invention in the operating or "up" position installed across the entrance of a cul-de-sac type ship berth.
Figure 2:
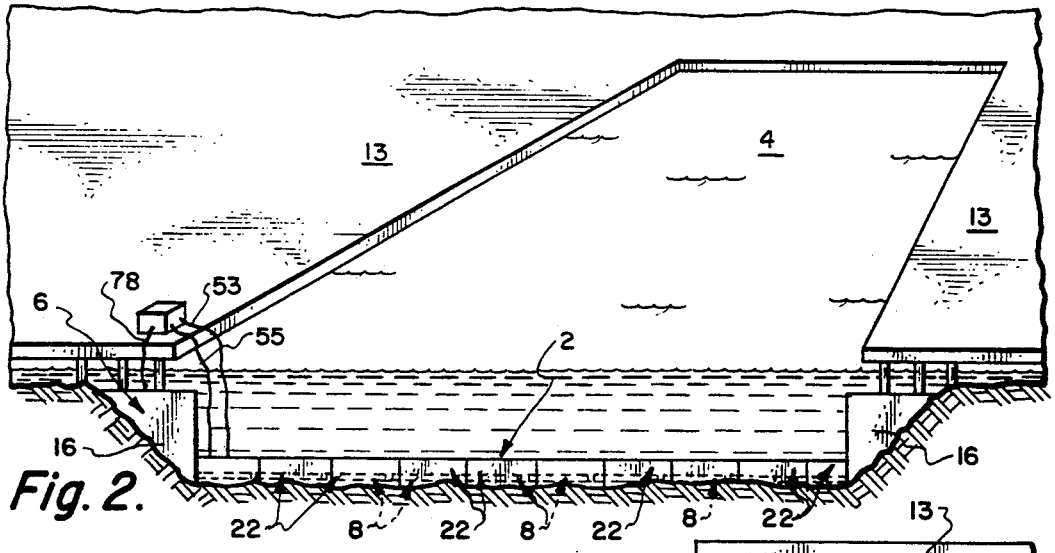
FIG. 2 shows the present invention in the "down" position allowing ships to enter and exit the berth.

The preferred embodiment of the present invention is illustrated by way of example in FIGS. 1 to 10. As shown in FIG. 1, barrier curtain 2 is in the operating or "up" position and includes a plurality of modules 8 fastened together in an end to end fashion to extend across the entrance of berth 4. As can be seen, barrier curtain 2 does not extend up to the water surface. As a result, harbor, maintenance and other craft with relatively shallow drafts as well as incoming and outgoing tides may pass in and out of berth 4 without impairment. The deeper waters which contain most of the silt and other undesirable matter, is prevented or blocked from entering berth 4 thereby reducing the tendency of silt to migrate from main channel 6 to berth 4. When it is desired to allow a ship of large draft to enter or exit berth 4, barrier curtain 2 may be quickly and easily lowered, as shown in FIG. 2, to allow such passage.

Figure 3:
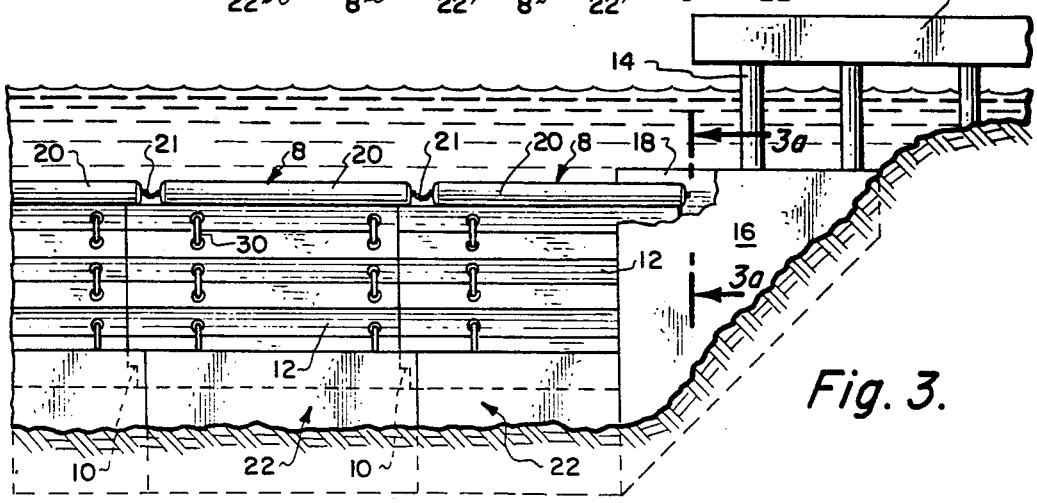
FIG. 3 is an elevation view of one end of the present invention shown in FIG. 1, showing three modules attached to pier pilings via a channeled gasket.

Referring now to FIG. 3, the preferred embodiment of barrier curtain 2 is made up from a plurality of substantially identical segments or modules 8, arranged and abutted in an end to end fashion to obtain the desired length for spanning a berth entrance. Each module 8 contains flap 10 on one end of screen 12 which extends outwardly and overlaps and fastens to screen 12 of an adjacent module 8. Plastic ties (not shown) may be used to fasten flap 10 of one module to screen 12 of an adjacent module and may be easily removed to allow for maintenance or repair. Either end module 8 of barrier curtain 2 may be connected to pier piling 14 via rubber gasket 16 which contains a "U" shaped channel 18 on one end. Screen 12 may be slidably inserted into channel 18. In this way, screen 12 is contained in horizontal motion yet is free to move up or down when, for example barrier curtain 2 is raised or lowered It should be noted that channel 18 must be sufficiently wide to allow float 20 to easily move up or down yet at the same time effect a seal so that silt and water will not leak past that portion of screen 12 contained within channel 18. To accomplish this seal, inflatable air bags 17 may be located on both sides of screen 12 in channel 18. The air bags may be inflated to cause a tight fit and prevent the flow of water and silt around screen 12. A suitable and preferred air bag is manufactured and commercially available from J.W. Automarine Corporation, P.O. Box 409, Chappaqua, N.Y., 10514. The non-channel end of gasket 16 ma be fastened to one or more pier pilings or other suitable available mounting point. The bottom side of gasket 16 may be buried, as shown, in the sea bottom to accomplish an effective seal.

FIG. 4 shows one module 8 of barrier curtain 2 and includes float 20, screen 12 and base 22. Screen 12 includes shield 24 which extends from screen 12 and around the silt or channel side of base 22. In this way, shield 24 may prevent sedimentation build-up on base 22 in the region designated as 26 in FIG. 4. As can be seen, screen 12 contains a plurality of laterally disposed folds or creases 28 arranged at approximately equal intervals from top to bottom. When screen 12 is lowered, creases 28 cause screen 12 to fold in a repeatable and predictable fashion on base 22. Screen 12 is attached along its top edge to float 20 and along its bottom edge to base 22. In the preferred embodiment, floats 20 are fabricated from foam filled PVC pipe with the ends sealed or capped off. Adjacent floats 20 are connected by chains 2! (see FIG. 3). Other types of flotation devices may be utilized. Cables 30 (part of the primary operating system to be described herein) are attached on one end to float 20 and on the other end to winch 50 (shown in FIGS. 6 and 7) mounted on base 22. It should be noted that winch 50 is located on the berth or non-sediment side of screen 12. As shown in FIG. 4, cables 30 extend through grommeted holes 32 in screen 12. When it is desired to raise screen 12, cables 30 are paid-out by winch 50, whereby float 20 is permitted to rise towards the sea surface, pulling screen 12 along with it. It should be noted that cables 30 take the stress created by the buoyancy of float 20 that would otherwise be taken by screen 12. Cables 30 also act to keep screen 12 in place when currents and tides are present and when raising and lowering screen 12. However, it may not be undesirable for screen 12 to act as a tension member when, for example, screen 12 is sufficiently strong to withstand the stresses acting on it. When it is desired to lower screen 12, winch 50 is reeledin, pulling float 20 towards base 22, thereby allowing screen 12 to slacken and predictably fold at creases 28 and rest on base 22. FIG. 5 shows screen 12 completely folded on base 22 with float 20 pulled to the fully retracted position. Note, in FIG. 5, that shield 24 continues to extend around the front of base 22 when screen 12 is fully retracted.

Figure 7:
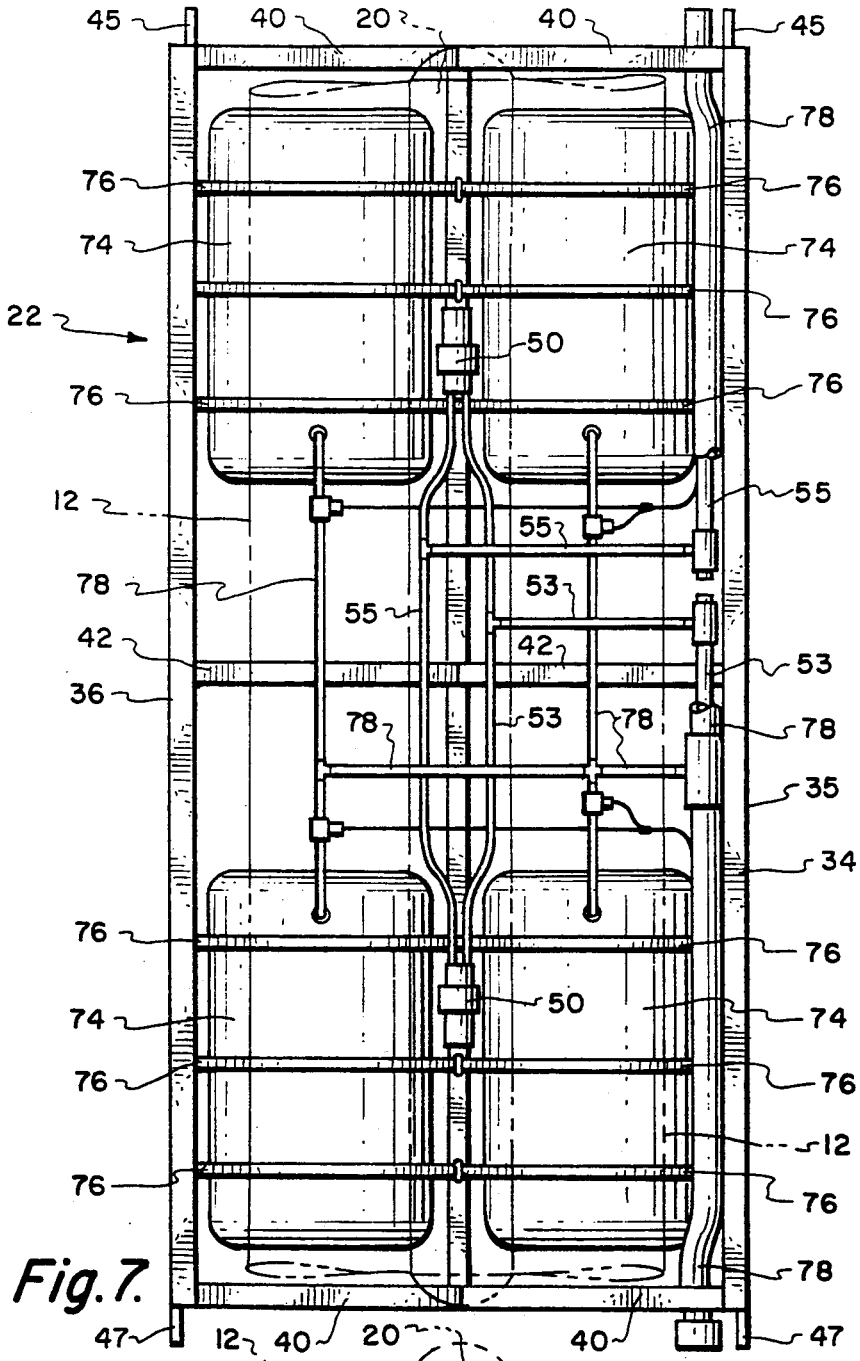
FIG. 7 is a plan view of a base showing the primary and secondary operating systems and a float.
Figure 6:
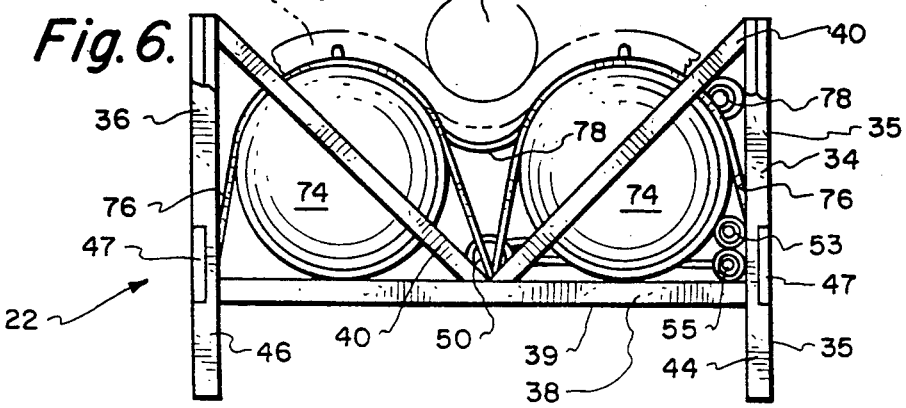
FIG. 6 is an end view of a base showing a float and screen, a winch from the primary operating system, fully inflated air bags with straps, the primary operating system supply and return lines and the secondary operating system air line.

Base 22 is best shown in detail in FIGS. 6 and 7 and includes sediment side 34, berth side 36, bottom 38, end braces 40 and center braces 42. Base 22 functions both as an anchor and as a mounting location for the primary and secondary operating systems. As an anchor, base 22 must be of sufficient size to avoid overturning and/or exceeding the bearing capacity of the soil and must be of sufficient weight (based on the (ocean) current loading and buoyancy of float 20) to avoid uplifting or moving. As a mounting location, base 22 houses both the primary and secondary operating systems as well as provide a location for the storage of folded and stowed screen 12 and float 20.

Accordingly, base 22 is rectangular in top view (see FIG. 7) and includes sediment side 34 and berth side 36 that extend below bottom 38 to form legs 44 and 46 respectively (see FIG. 6). Skin 35 is attached to the outward facing side of both side 34 and leg 44. In addition, skin 39 is attached to the bottom side of bottom 38. Skin 35 and 39 may be any impervious material, such as, aluminum, steel or plastic. Thus when combined with raised screen 12 and shield 24 both of impervious material, such as rubber coated fabric (eg. hypalon), barrier curtain 2 provides a continuous barrier for migrating silt thereby isolating and preventing an area, such as a berth, from filling with sediment. In the preferred embodiment, for example, base 22 is fabricated from a non corrosive material or from steel suitably protected as by galvanite coating or painting.

As shown in FIG. 8, it is envisioned that base 22 will be located in a trench on the sea floor so that, when screen 12 is fully retracted, float 20 will be closer to the sea bottom. In this way, ships with large drafts may ingress and egress a berth without impairment. The trench may be as deep as necessary to provide the necessary clearance. In some cases, however, a trench may not be required.

Each base unit 22 may be attached to an adjacent base unit 22 by means of inside connector 45 and outside connector 47 located, for example, on opposite sides of each base 22. When adjacent bases are aligned inside connectors 45 of a first base 22 are aligned with outside connectors 47 of a second base 22 whereby, a pin (not shown) may be inserted through bores (not shown) in aligned connectors 45 and 47. Those skilled in the art would immediately recognize other alternative connection means.

Figure 9:
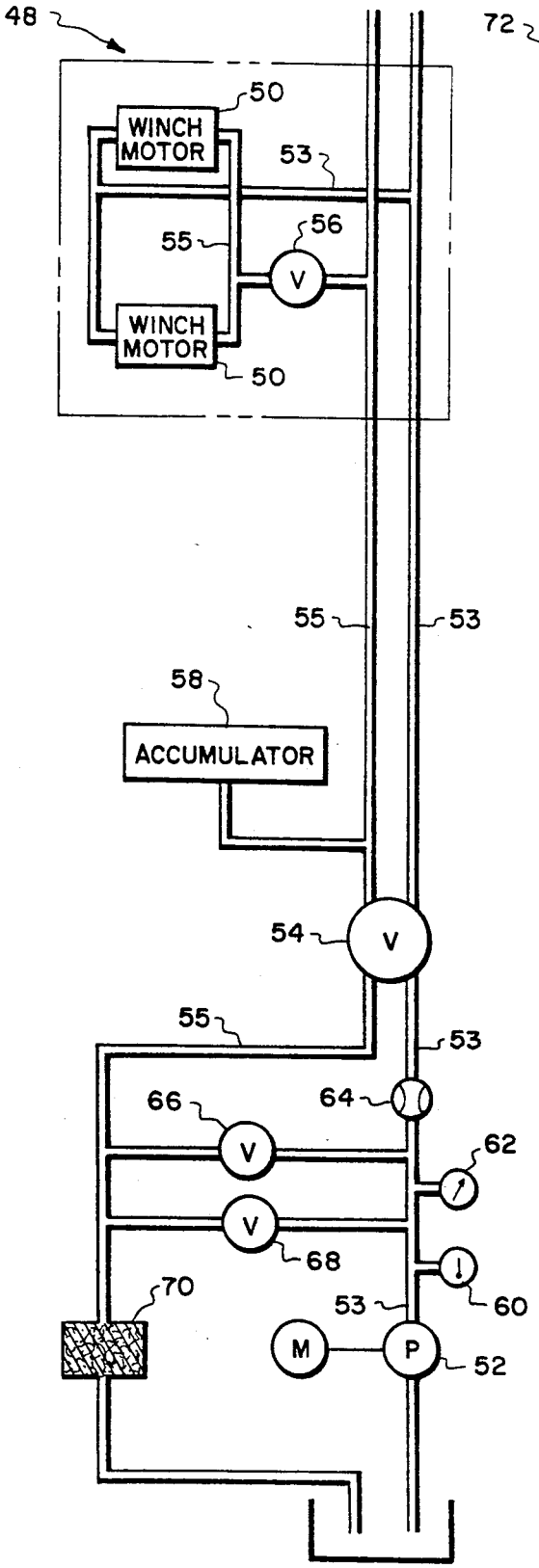
FIG. 9 is a schematic of the primary operating system.

The raising and lowering of screen 12 is controlled by Primary Operating System (POS) 48 shown schematically in FIG. 9 and mechanically in FIGS. 6 and 7. It should be noted that POS 48 is shown along with Secondary Operating System (SOS) 72 in both FIGS. 6 and 7. For clarity purposes, no number 48 or 72 appears in either FIG. 6 or 7. However, the individual components of POS 48 and SOS 72, that are shown in FIGS. 6 and 7, are numbered. Referring to FIGS. 6 and 7, POS 48 includes winches 50 mounted on base 22 and attached to cables 30 (part of POS 48). Winches 50 are caused to reel-in or let-out cables 30 thereby raising or lowering screen 12. In the preferred embodiment, winches 50 are hydraulically powered but other types, such as electric, mechanical or seawater powered may also be employed by those skilled in the art. Hydraulic lines, 53 for supply and 55 for return are shown. Referring to FIG. 9, the components of POS 48 are shown schematically and include hydraulic pump 52 which may be land mounted, for example, on pier 13. Hydraulic pressure is supplied via supply line 53 to winches 50 arranged in parallel so that both winches 50 of each module 8 will operate in unison. Return flow is via return line 55. It should be noted that when two or more modules 8 are used, supply line 53 communicates with all modules so that hydraulic pressure is delivered throughout the system. In a like manner, return line 55 communicates with all modules in the system. FIG. 9 shows a single module 8 but as many other modules 8 as desired may be added. Flow control valve 56 provides flexibility in controlling and matching the operation of each module 8 so that all modules in barrier curtain 2 may operate at the same rate. Direction control valve 54 provides for up or down motion and accumulator 58 maintains the hydraulic pressure. To monitor the operational characteristics of the system, thermometer 60, pressure gauge 62 and flow meter 64 are provided. Relief valve 66 and bypass valve 68 are provided for safety purposes and reliability, and filter 70 provides longevity.

Figure 10:
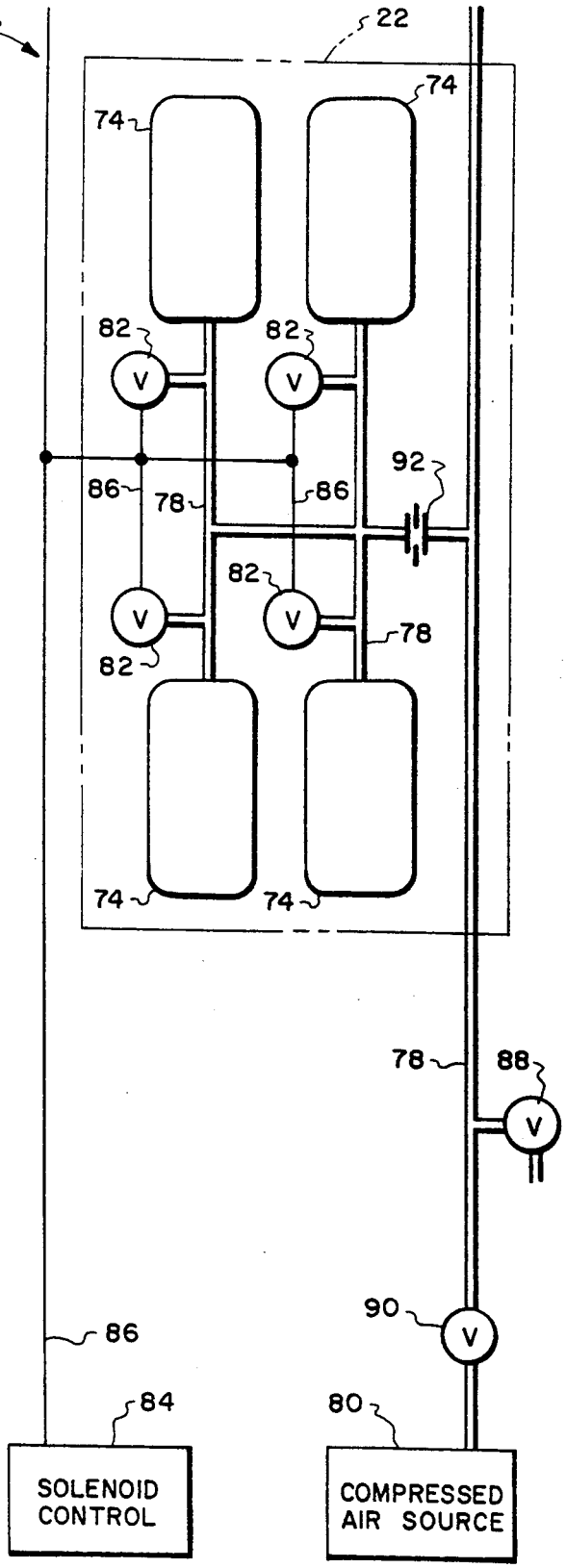
FIG. 10 is a schematic of the secondary operating system.

Barrier curtain 2 may be removed for servicing, repair or when, for example, a berth is in need of dredging. This is accomplished by secondary operating system (SOS) 72 mounted on bottom 38 of base 22. As shown in FIGS. 6 and 7, SOS includes air bags 74 held in place by straps 76 and supplied with compressed air delivered through air lines 78. A suitable and preferred air bag is manufactured and commercially available from J.W. Automarine Corporation, P.O. Box 409, Chappaqua, N.Y., 10514. Other types of air bags may be employed by those skilled in the art. FIG. 10 is a schematic, showing the components of SOS 72 and includes compressed air source 80 mounted on pier 13 (not shown), air lines 78, compressed air solenoid valves 82, solenoid control 84, wiring 86 for controlling air flow to air bags 74, dump valve 88 and isolation valve 90. Orifice 92 is provided in air lines 78 to create an inlet back pressure sufficient to ensure a nearly constant volume of air flow to each module when, for example, a broken air bag 74 is present. Entire barrier curtain 2 may be raised by simultaneously inflating all air bags 74 of all modules. Air line 78 thus connects to all modules 8. Once barrier curtain 2 has been raised and floated it may be towed to any appropriate location.

It should be noted that air bags 74 are shown in the fully inflated mode in FIG. 6. Thus, when screen 12 is in the fully retracted position and folded and stored on base 22, screen 12 will not "sit" flat as shown in FIGS. 5 and 8 but will be located between and on-top-of air bags 74. In addition, it is desirable to size air bags 74 so that each module 8 can be raised to the sea surface with less than four air bags 74 in the event that one air bag 74 fails.

Obviously many modifications and variations of the present invention are possible in light of the above teachings. It is therefore to be understood that within the scope of the appended claims, the invention may be practiced otherwise than as specifically described.

What is claimed is:

1. A collapsible barrier curtain comprising:
a base located on the sea floor;
a float for providing a buoyancy force;
screening means interposed between and attached to the base and the float and extending from one side of said base to the opposite side of said base for preventing sedimentation in a berth;
lowering means communicating with said float for pulling said float towards said base wherein the screening means is allowed to rest in a folded manner on said base, the lowering means also operable to allow said float to rise towards the sea surface wherein said screening means is caused to extend towards the sea surface; and
means for floating the barrier curtain to the sea surface wherein said barrier curtain may then be towed for repair or relocation.

2. The apparatus defined in claim 1, wherein said screening means includes creases.

3. The apparatus defined in claim 2, wherein said screening means includes a flap.

4. The apparatus defined in claim 3, wherein said float is cylindrical in shape.

5. The apparatus defined in claim 4, wherein said base includes a sediment side, a berth side, a bottom, a leg on the sediment side and leg on the berth side.

6. The apparatus defined in claim 5, wherein the sediment side, the leg on the sediment side and the bottom include a skin to prevent the flow through of debris and sediment.

7. The apparatus defined in claim 6, wherein said screening means includes grommeted holes.

8. The apparatus defined in claim 7, wherein one or more ends of said barrier curtain slidably communicates with a gasket.

9. The apparatus defined in claim 8, wherein the gasket is U-shaped.

10. The apparatus defined in claim 9, wherein said U-shaped gasket includes sealing means for preventing the flow of water and sediment between said screen and said U-shaped gasket.

11. The apparatus defined in claim 10, wherein sealing means is interposed between said screen and said U-shaped gasket on one or more sides of said screen.

12. A collapsible barrier curtain comprising at least two modules attached and arranged in an end to end configuration forming an elongate, substantially continuous barrier across the entrance of a berth and extending from the sea floor upwardly towards the sea surface, each module including:
a base located on the sea floor;
a float for providing a buoyancy force;
screening means interposed between and attached to the base and the float and extending from one side of said base to the opposite side of said base for preventing sedimentation in a berth;
lowering means communicating with said float for pulling said float towards said base wherein the screening means is allowed to rest in a folded manner on said base, the lowering means also operable to allow said float to rise towards the sea surface wherein said screening means is caused to extend towards the sea surface; and means for floating the barrier curtain to the sea surface wherein said barrier curtain may then be towed for repair or relocation.

13. The apparatus defined in claim 12, wherein said screening means includes creases.

14. The apparatus defined in claim 13, wherein said screening means includes a flap.

15. The apparatus defined in claim 14, wherein adjacent said screens overlap.

16. The apparatus defined in claim 15, wherein said float is cylindrical in shape.

17. The apparatus defined in claim 16, wherein said base includes a sediment side, a berth side, a bottom, a leg on the sediment side and leg on the berth side.

18. The apparatus defined in claim 17, wherein the sediment side, the leg on the sediment side and the bottom include a skin to prevent the flow through of debris and sediment.

19. The apparatus defined in claim 18, wherein said screening means includes grommeted holes.

20. The apparatus defined in claim 19, wherein one or more ends of said barrier curtain slidably communicates with a gasket.

21. The apparatus defined in claim 20, wherein the gasket is U-shaped.

22. The apparatus defined in claim 21, wherein said U-shaped gasket includes sealing means for preventing the flow of water and sediment between said screen and said U-shaped gasket.

23. The apparatus defined in claim 22, wherein sealing means is interposed between said screen and said U-shaped gasket on one or more sides of said screen.

* * * * *